United States Patent [19]

Lucassen et al.

[11] Patent Number: 4,866,815

[45] Date of Patent: Sep. 19, 1989

[54] APPARATUS FOR SEPARATING IMPURITIES FROM A FIBER MATERIAL FLOW, IN PARTICULAR SPINNING MATERIAL FIBERS

[75] Inventors: Guenter Lucassen, Haltern; Akiva Pinto, Duesseldorf; Reinhard Schmidt, Gescher, all of Fed. Rep. of Germany

[73] Assignee: Hergeth Hollingsworth GmbH, Duelman, Fed. Rep. of Germany

[21] Appl. No.: 242,013

[22] Filed: Sep. 8, 1988

[30] Foreign Application Priority Data

Sep. 19, 1987 [DE] Fed. Rep. of Germany ..... 3731591

[51] Int. Cl.[4] ..... D01G 9/08; D01G 9/20

[52] U.S. Cl. ..... 19/205; 19/200

[58] Field of Search ..... 19/66 R, 66 CC, 66 T, 19/105, 200, 204, 205

[56] References Cited

U.S. PATENT DOCUMENTS

| | | | |
|---|---|---|---|
| 1,123,344 | 1/1915 | Meurling | 19/205 X |
| 1,128,758 | 2/1915 | Cheesman | 19/205 |
| 2,810,163 | 10/1957 | Kyame et al. | 19/205 X |
| 2,929,112 | 3/1960 | Massey et al. | 19/205 |
| 3,096,276 | 7/1963 | Franks et al. | 19/200 X |
| 4,479,286 | 10/1984 | Brown et al. | 19/200 |
| 4,736,493 | 4/1988 | Hanss-Zollick et al. | 19/200 |

FOREIGN PATENT DOCUMENTS

| | | | |
|---|---|---|---|
| 570157 | 4/1924 | France | 19/205 |
| 572566 | 6/1924 | France | 19/205 |

*Primary Examiner*—Donald Watkins

*Attorney, Agent, or Firm*—Cort Flint

[57] ABSTRACT

Apparatus for separating waste particles from a textile fiber flow is disclosed which includes a housing (2, 22, 34) with a deviation zone (4) and separation zone (6). Following the deviation zone is a fiber flow discharge channel (5). Following a separation means (10, 11, 23) is a waste chamber (7) for removing large and small particles of waste. The waste particle separation device includes a plurality of rod elements (10, 11) which are curved to guide lighter particles upwardly to prevent adherence to the separating element. Larger particles pass through openings between the rod-like elements to the collection chamber. Communication between the fiber flow and the waste flow may be had by using a valve member (27, 35) to intermittently connect a collection channel (25) with a suction removal source (8) via waste chamber (7).

21 Claims, 4 Drawing Sheets

APPARATUS FOR SEPARATING IMPURITIES FROM A FIBER MATERIAL FLOW, IN PARTICULAR SPINNING MATERIAL FIBERS

BACKGROUND OF THE INVENTION

The invention relates to apparatus for removing impurities, e.g. heavy components such as husks, leaves and stem particles from a fiber material flow, in particular from spinning material fibers, e.g. textile fiber flocks of cotton, etc. The fiber material flow is pneumatically conveyed past a deviation zone. Within the deviation zone, separation of heavy components is provided by openings in the form of a screen or grid etc. Upon its deviation, the fiber material air current is further conducted in a channel.

There have been known various embodiments of separating means for removing waste particles from a textile fiber material current. The waste particles which, for the major part, are heavier than the fiber material, are removed by air sifting. In a separation zone, generally disposed in a deviation portion of a channel for the fiber flow, there are arranged grids formed of separating blades disposed in mutually parallel relationship. The separating blades are mounted transversely to the flow direction of the fiber material. However, the separating action is substantially affected by such a grid design. Due to the centrifugal force, heavy particles of the impurities are generally urged through the separating blades into a collecting chamber situated behind the blades. The lighter waste particles and even the fibers, often accumulate at the grid blades which are transverse to the flow direction. The lighter particles tend to adhere to the front edge of the grid knives. There is little chance for the lighter particles to be automatically liberated from said grid knives. There is a risk that the separating grid will become clogged, if passage through the grid knives is constricted by an accumulation of the lighter fiber particles.

It is the object of the invention to substantially improve the reliable and safe separating effect of a grid at the deviation point for a fiber material flow.

SUMMARY OF THE INVENTION

The above objective and others are accomplished by separating elements used in the separating zone which are guiding elements extending in the direction of the fiber flow terminating in free ends. Due to this design of the separating zone, the heavy particles of the impurities move relatively freely by inertia between the guide elements into a waste chamber. Since the guide elements extend substantially in the direction of fiber flow, it is not important whether the paths of the fibers through the grid to be straight or curved. The space between the guide elements is open towards the fiber flow so that, contrary to the conventional grids formed of transverse separating elements, the guide elements do not interfere and present obstacles to the flow. Lighter impurities which possibly could adhere to the guide elements, may slide along the guide elements to their free ends to substantially drop into the waste chamber. A self-cleaning effect is imparted by the air current to the guide elements at the separation zone. It is favorable for the rod-shaped guide elements at the separation zone to form a rake extending over a width of the fiber material flow. The rod-shaped guide elements are preferably made of round steel or plastic bars.

According to another feature of the invention, the rod-shaped guide elements vary in length. Short and long guide rods are arranged alternatingly side by side and 10 may extend in a curved shape. Suitably, the curvature of the short and of the long guide rods is different. In view of such a separation zone, two open rakes are practically formed in the conveying direction which allow for a supplementary separating effect. The rake formed of the short rods additionally guides the fiber flow in the conveying direction. The curvature of the guide rods is dictated by the direction in which the fiber material current is conveyed. The design of the separating zone is quite simple and its efficiency is considerable. Moreover, the invention provides that the rod-shaped guide elements or rakes are disposed pivotally. The rake formed of the short guide rods and that of the long guide rods may be rotatable independently of each other. As a result of such a possible adjustment of the separating rakes, the separation zone may be well adapted to the type and quantity of the fibers in the material flow. Further, a deflection element having a triangular cross section and also being adjustable may be arranged above and spaced from the rod-shaped guide elements. By this means, it is ensured that the impurities are safely introduced into the waste chamber.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
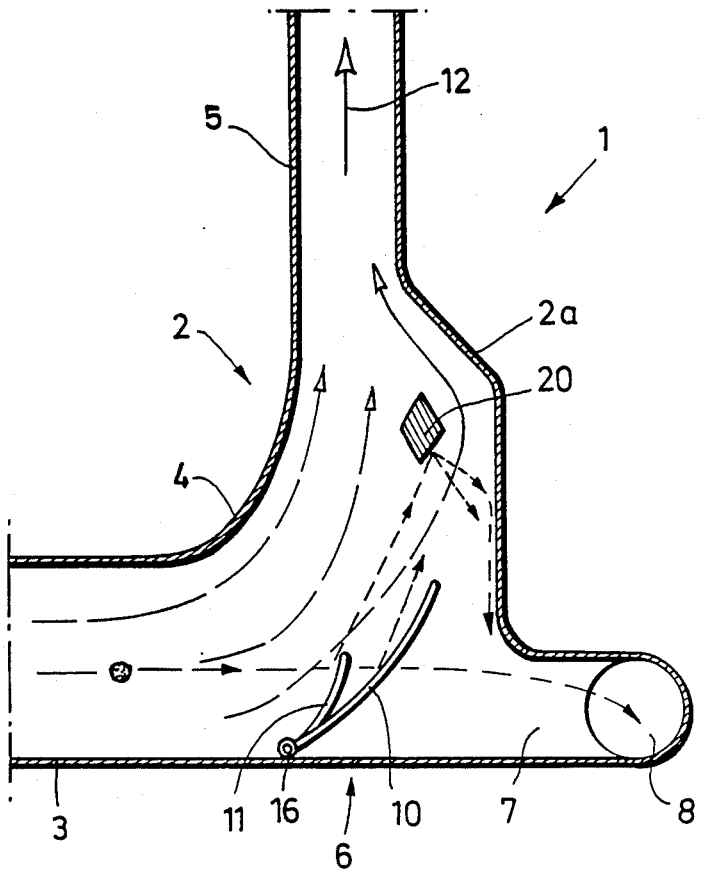
FIG. 1 is a schematic plan view of an embodiment of the apparatus of the invention used for separating impurities from a fiber flow.
Figure 2:
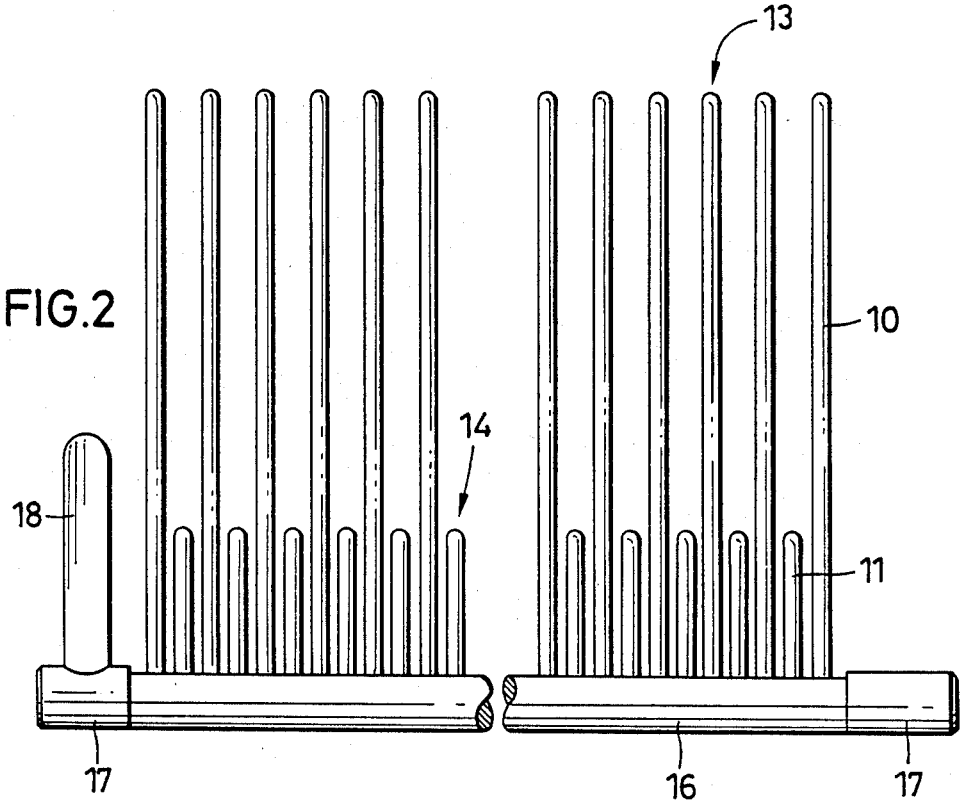
FIG. 2 is a schematic elevational view of a separating rake of the invention for separating impurities from a fiber flow.
Figure 3:
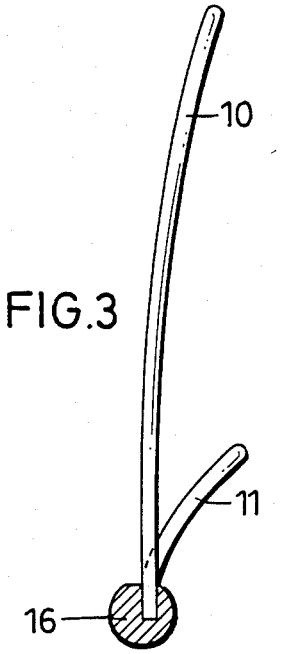
FIG. 3 is a schematic side view of the separating rake of FIG. 2.

Referring now in more detail to the drawings, apparatus 1 is disclosed for separating impurities from a pneumatically conveyed fiber material flow. The apparatus comprises a housing 2 composed of a feed portion 3, an air flow deviation portion 4 and a discharge portion 5. It is possible for portions 3 and 5 to pipe elements of a round or rectangular cross section. The deviation portion 4 accommodates a separation zone 6 for removing impurities from the fiber flow and behind which a collection chamber 7 is provided which is joined by the suction piece 8. Sucking of the waste may be performed continuously, e.g. by interposing a cell wheel sluice, or intermittently.

A fiber waste separation means is disposed in the separation zone 6 which includes guide elements 10, 11 extending substantially in the direction of fiber flow 12 and terminating in free ends. Guide elements 10, 11 are formed of rods, preferably of a round shape of steel or plastics, etc. Rods 10, 11 form a rake 13, 14 extending over the width of the fiber material flow and being open in a conveying direction.

Preferably, the rod-shaped guide elements 10, 11 vary in length. Suitably, short and long guide rods should be arranged alternatingly side by side. The ratio of short to long rods may be within the range of one-fifth to one-third.

It is an advantage if rod-shaped guide elements 10, 11 are curved. The curvature may be dictated by an angle at which discharge portion 5 is disposed relative to feed portion 3 of housing 2. If the angle or deviation is generally perpendicular or acute, the curvature relative to the fiber flow is generally concave. If the deviation is rather obese, the resultant curvature of the rods may be convex. Suitably, the curvature of the shorter guide rods is sharper than that of the longer rods. The rake formed by the shorter guide rods is adapted to support the deviation of the fiber flow.

The angular disposition of rod-shaped guide elements 10,11 in the housing should be adjustable. To this effect, rods 10 and 11 may be fixed to a shaft 16 whose ends 17 are pivotally disposed in the side walls of the housing 2. A handle 18 outside the housing provided at one or both sides of shaft 16 may be used for adjusting the angle of the shaft 16 with rods 10 and 11. One may also provide an angularly adjustable shaft for each rake 13, 14. Both shafts may be in coaxial relationship.

A pivotally mounted deflection member 20 may be mounted transversely across housing 2 above rods 10 and 11 at a predetermined distance therefrom. Preferably, deflection member 20 is in the form of a deflection bar having a triangular cross-section. An apex of the bar is directed towards rakes 13, 14. Further, housing 2 may contain a protuberance **2*a* so that the fiber air current may flow in front of and behind deflection bar 20 towards discharge portion 5**.

During the deviation, the heavier particles of impurities in the fiber material flow may be thrown substantially horizontally through rakes 13 and 1 into the waste collection chamber 7. The lighter particles of impurities, unless they also get through the rakes, may slide along rods 10, 11 as far as to the free ends to reach the rear housing portion which is less exposed to the fiber flow. The lighter particles may drop into collection chamber 7. The deflection member 20 will support such an effect. The 10 fiber material flocks freed from impurities are conveyed into the discharge portion 5 of housing 2 as the fiber air current is diverted. The paths followed by the lighter and heavier particles of the impurities are shown in dotted lines in FIG. 1 as **15*a* and 15*b***, respectively.

Figure 4:
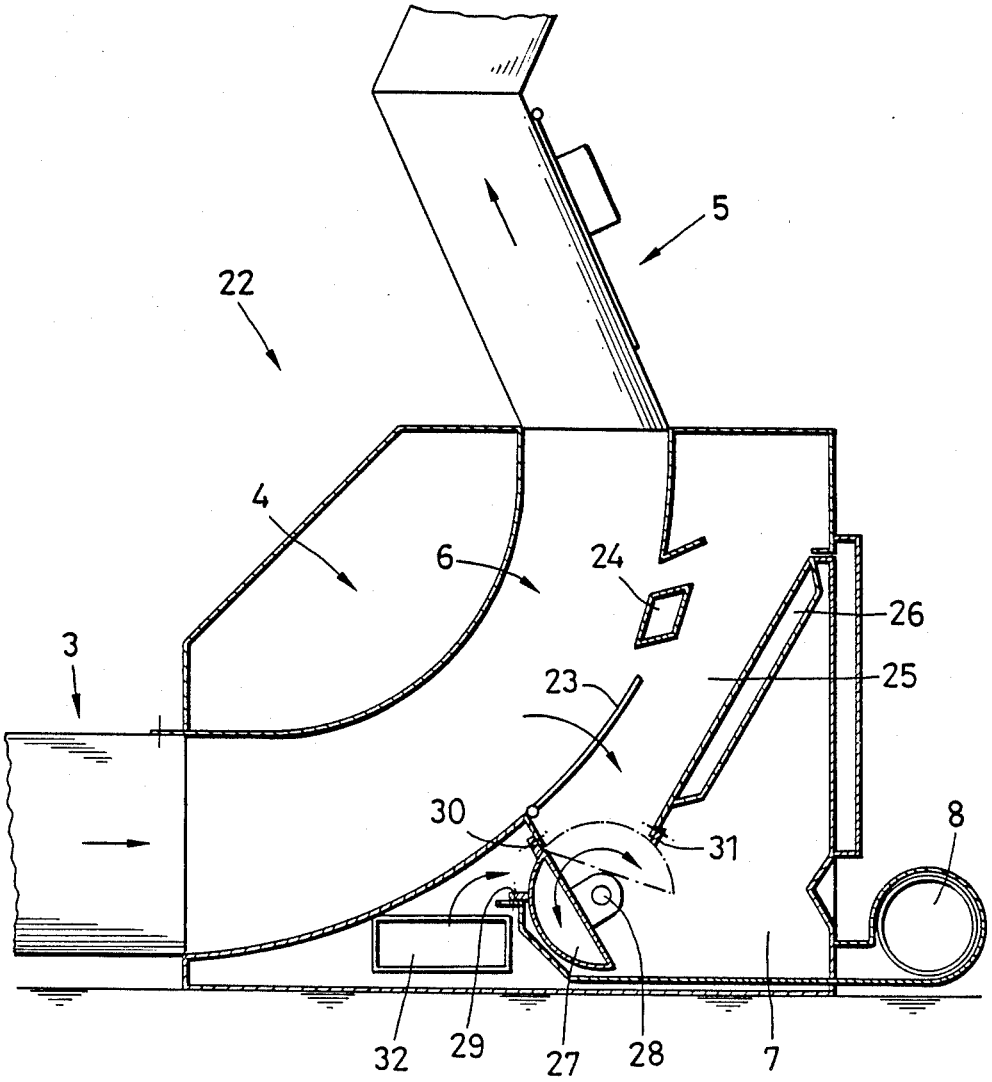
FIG. 4 illustrates an additional embodiment.

In case of the housing embodiment 22 of FIG. 4, behind a pivotable rake 23 and a rotatable deflection member 24, a collection channel 25 is provided for the waste. Channel 25 is confined by a chute surface, e.g. an inclined metal sheet 26. Between waste collecting channel 25 and a waste disposal point 8, there is arranged a valve member 27 by which a passage from waste collection channel 25 to collecting chamber 7 of the disposal point 8 may be closed. In case of the illustrated example, the member 27 is a rotary slide adapted to rotate with axle 28. Not only in the illustrated open position, but also in the dash-dotted closed position, rotary slide 27 is sealed by strips 29, 30, 31 against the environment. Behind valve member 27 in its open position, is an aperture 32 for entry of secondary air during suction which is performed intermittently. If valve member 27 is closed, the waste disposal is carried out by suction. If valve member is open, suction at the waste disposal point 8 is stopped to avoid conveying of impurity-freed fibers into the waste disposal zone.

Figure 5:
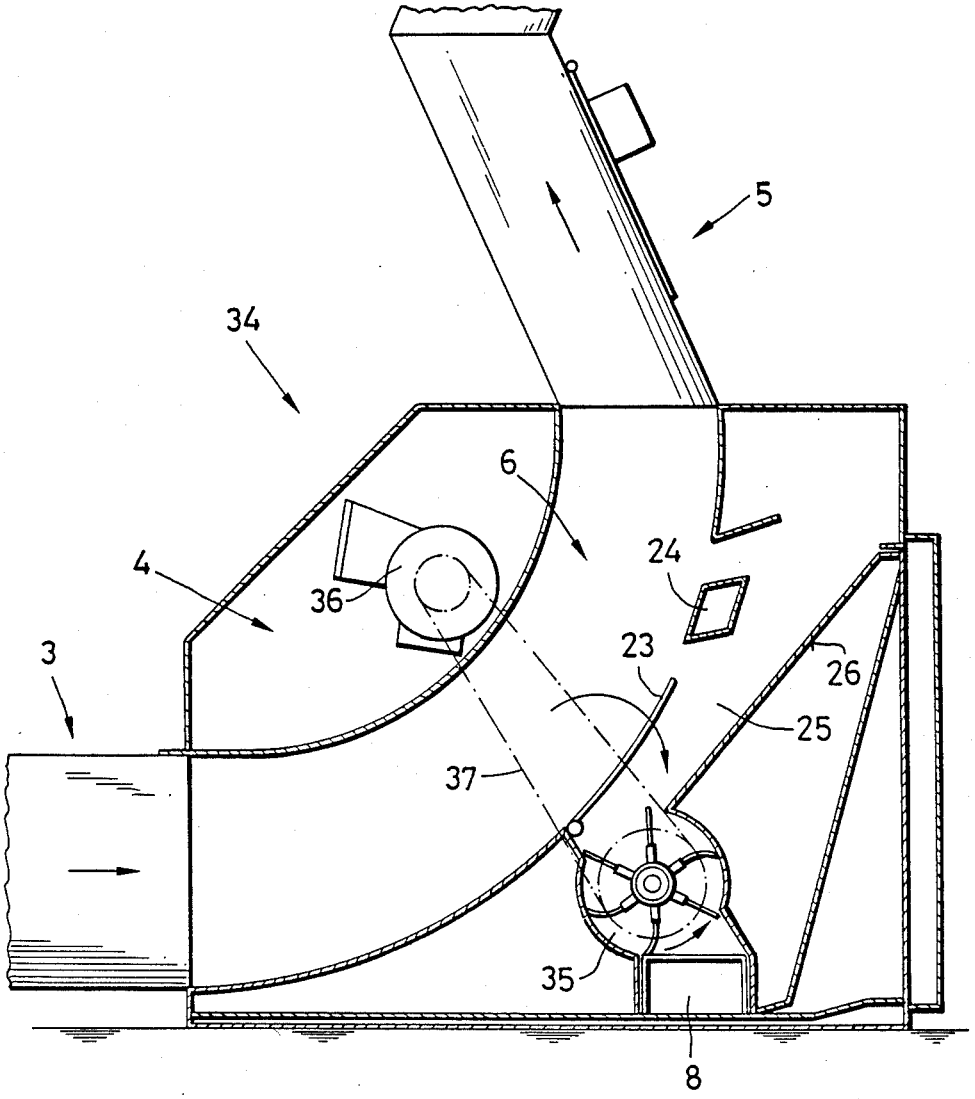
FIG. 5 illustrates an additional embodiment.

The embodiment of FIG. 5 substantially corresponds to that of FIG. 4. At the end of collecting 10 channel 25, a cell wheel sluice 35 is provided as an end member which may be followed directly by the waste disposal point 8. Due to the cell wheel sluice 35, a constant closure of the exit of waste collecting channel 25 is ensured. A continuous suction is provided at the disposal point 8. Purified fibers may not be entrained accordingly. A motor 36 with transmission member 37 is provided for driving the cell wheel sluice 35.

Due to the conveying air current in the separation device and by means of the deflection member 24, the heavier particles of the impurities will generally get into the waste collecting channel to drop to the valve member. In the collecting channel 25, solenoids may be mounted at a convenient point to remove iron particles, etc. The design of the rake 23 may vary. Preferably, use is made of a comb-type rake or of a usual grid or perforated plate. The valve member may be provided correspondingly also in case of the embodiment of FIG. 1.

While a preferred embodiment of the invention has been described using specific terms, such description is for illustrative purposes only, and it is to be understood that changes and variations may be made without departing from the spirit or scope of the following claims.

What is claimed is:

1. Apparatus for removing waste particles like husks, leaves, stems, and the like from textile fibers in a fiber flow, wherein the fiber flow is pneumatically conveyed through a housing having a deviation zone, a separation zone, in separation means carried in said deviation zone for separating said waste particles from said fiber material flow, said waste particles being passed to a collection chamber for removal, and said fiber flow is conveyed to a discharge channel after passing said deviation zone, characterized in that the separation means includes guide elements disposed in separation zone extending generally in direction of said fiber flow terminating in free ends.

2. The apparatus of claim 1 wherein said guide elements include guide rods that form a rake extending over a width of said fiber flow and being open in conveying direction.

3. The apparatus of claim 2, wherein said guide elements include a first plurality of long rods having a first length and a second plurality of short rods having a second length shorter than said first length

4. The apparatus of claim 3 wherein said long and short guide rods are arranged alternatingly side by side.

5. The apparatus of claim 2 wherein said guide rods are curved.

6. The apparatus of claim 5 wherein curvatures of said short guide rods and of said long guide rods are different.

7. The apparatus of claim 2 wherein said guide rods are round bars of steel.

8. The apparatus of claim 2 wherein said guide rods are round bars of plastic.

9. The apparatus of claim 2 wherein said guide rods are pivotally supported.

10. The apparatus of claim 3 wherein said short guide rods and said long guide rods are supported pivotally independently of each other.

11. The apparatus of claim including a deflection means disposed above and spaced from said guide elements for deflecting said particles toward said collection chamber.

12. The apparatus of claim wherein said deflection means includes a deflection bar, and means for pivotally carrying said bar across said housing.

13. The apparatus of claim 1 including a suction means for said waste particles arranged behind said separation means in said collection chamber.

14. The apparatus of claim 1 including a waste channel disposed generally behind said separation zone having a passage connected to said collection chamber, and a valve member disposed between said waste channel and said collection chamber to interrupt the connection between the waste channel to said collection chamber with a sealing effect.

15. The apparatus of claim 14., wherein said waste channel is defined by an inclined surface inclined towards the collection chamber.

16. The apparatus of claim 14 including an aperture behind said valve member provided for the entry of secondary air.

17. The apparatus of claim 16 wherein said valve member includes a cell wheel sluice.

18. Apparatus for separating waste particles from a textile fiber flow comprising in combination:

a housing having a waste particle separation zone and a fiber flow deviation zone;

a separation means disposed within said housing near said separation zone;

a waste collection channel disposed behind said separation means;

a waste disposal chamber arranged behind said waste collection channel;

a passage connecting said collection channel and said waste disposal chamber;

a valve member carried in said passage for selectively opening and closing said passage so that fluid communication between said collection channel and waste disposal chambers is respectively opened and closed; and suction means for removing waste particles from said disposal chamber.

19. The apparatus of claim 18 wherein said separation means includes a rake element extending transversely across said housing inclined in a direction of said fiber flow, said rake element including a plurality of guide rods terminating in free ends for guiding said waste particles, and said guide rods being spaced apart to define openings through which larger waste particles may pass while smaller waste particles are guided by said rods over the free ends thereof.

20. The apparatus of claim 19 wherein said guide rods are curved and include a plurality of short guide rods and a plurality of long guide rods having a length greater than said short guide rods.

21. The apparatus of claim 20 wherein said short and long guide rods alternate in side-by-side relation.

* * * * *